US005341908A

United States Patent [19]

Furneaux

[11] Patent Number: 5,341,908

[45] Date of Patent: Aug. 30, 1994

[54] METHOD AND APPARATUS FOR TESTING COINS

[75] Inventor: David M. Furneaux, Maidenhead, United Kingdom

[73] Assignee: Mars Incorporated, McLean, Va.

[21] Appl. No.: 946,326

[22] PCT Filed: Apr. 29, 1991

[86] PCT No.: PCT/GB91/00680

§ 371 Date: Nov. 6, 1992

§ 102(e) Date: Nov. 6, 1992

[87] PCT Pub. No.: WO91/17527

PCT Pub. Date: Nov. 14, 1991

[30] Foreign Application Priority Data

May 10, 1990 [GB] United Kingdom ..... 9010507

[51] Int. Cl.[5] ..... G07D 5/08

[52] U.S. Cl. ..... 194/317

[58] Field of Search ..... 194/317, 318, 319

[56] References Cited

U.S. PATENT DOCUMENTS 4,946,019 8/1990 Yamashita ..... 194/318

FOREIGN PATENT DOCUMENTS 0062411 10/1982 European Pat. Off. .
0203702 12/1986 European Pat. Off. .
0300781 1/1989 European Pat. Off. .
0331530 9/1989 European Pat. Off. .
0336018 10/1989 European Pat. Off. .
3034156 3/1982 Fed. Rep. of Germany .
3708275 9/1987 Fed. Rep. of Germany .
2093620 9/1982 United Kingdom .
2143663 2/1985 United Kingdom .
2143982 2/1985 United Kingdom .

*Primary Examiner*—F. J. Bartuska
*Attorney, Agent, or Firm*—Davis Hoxie Faithfull & Hapgood

[57] ABSTRACT

A method and apparatus for testing coins is described. In particular, the resistance introduced into a tuned circuit by the proximity of a coin while it is moving past an inductor of the circuit is determined by changing the amount of phase shift present in a feedback path associated with the circuit and measuring the resulting change in frequency of oscillation, which is dependent upon the resistance in the tune circuit.

16 Claims, 3 Drawing Sheets

34
f0
fø
f'ø
Δf
R
L
A
B
C
D
E
F
80
82
A1
A2
A3
A30
A31
A32
B1
B2
B3
B30
B31
B32
C1
C2
C30
C31
A2-C1
A3-C2
A31-C30
A32-C31
COIN ABSENT
COIN PRESENT

METHOD AND APPARATUS FOR TESTING COINS

FIELD OF THE INVENTION

This invention relates to a method and apparatus for testing coins.

BACKGROUND OF THE INVENTION

In this specification, the term "coin" is used to encompass genuine coins, tokens, counterfeit coins and any other objects which may be used in an attempt to operate coin-operated equipment.

Coin testing apparatus is well known in which a coin is subjected to a test by passing it through a passageway in which it enters an oscillating magnetic field produced by an inductor and measuring the degree of interaction between the coin and the field, the resulting measurement being dependent upon one or more characteristics of the coin and being compared with a reference value, or each of a set of reference values, corresponding to the measurement obtained from one or more denominations of acceptable coin. It is most usual to apply more than one such test, the respective tests being responsive to respective different coin characteristics, and to judge the tested coin acceptable only if all the test results are appropriate to a single, acceptable, denomination of coin. An example of such apparatus is described in GB-A-2 093 620.

One particular test which is often applied is to determine the maximum effect that the coin has on the amplitude of a signal derived from the inductor. This may be done simply by measuring the peak value that the amplitude reaches as the coin passes by the inductor, or measuring both that peak amplitude, and also the amplitude when the coin is not adjacent to the inductor and taking a function of (for example, either the difference between, or the ratio of) those two amplitudes so as to obtain a value which is less influenced by drift in the circuitry and variations in component parameters. These tests based on amplitude give an indication of the effective resistance (or loss) that is introduced into the inductor circuit by the coin when the coin is sufficiently close to the inductor that eddy currents are being induced in it.

In EP-B1-0 062 411 there is disclosed a method of testing coins in which, as one feature, the effective resistance or loss of a coil, as influenced by a coin held stationary adjacent the coil, is measured by switching a phase change repeatedly into, and out of, the feed back loop of an oscillating tuned circuit, measuring the oscillation frequency with the phase change in the circuit, and without the phase change in the circuit, and taking the difference between the two measured frequencies as an indication of effective resistance. It is inherent in that method that frequency measurements have to be taken on the same coin, using the same circuit, but at different times. To enable this to be done, EP-B1-0 062 411 proposes that after the arrival of a coin in the testing apparatus has been detected a delay of one third of a second is provided to allow the coin to come to rest in a fixed stable position against a stop in a coin runway, where the coin is located between the two halves of a testing coil. When the coin is in that fixed position, the phase change is repeatedly switched into and out of the oscillator circuit for periods which are at least 3.75 ms long, and this is done many times whilst frequency measurements are taken, the coin then being released by the stop to continue its passage through the testing apparatus.

Although in principle this is a useful way of measuring resistance or loss, in practice the need to hold the coin stationary makes the method and apparatus unsuitable for testing a succession of coins rapidly one after the other, which is a requirement in most practical applications of coin testing apparatus.

SUMMARY OF THE INVENTION

The invention involves the realisation that, contrary to the disclosure in the above prior art, it is possible to perform a similar method of measuring effective resistance or loss while the coin is actually moving past the inductor of a tuned circuit.

More particularly, the invention provides a method of testing coins using an oscillating tuned circuit which includes an inductor, three parameters of the tuned circuit being interdependent, namely:

a) the effective resistance in the circuit b) the phase of a signal in the circuit, and c) the frequency of oscillation of the circuit, the method comprising imposing a change in said phase when a coin is adjacent to the inductor, deriving from the resulting frequency change a value dependent on the effective resistance in the tuned circuit as influenced by the coin, and using the derived value in a coin acceptability check, characterised by causing the coin to move past the inductor during said phase change and the resulting frequency change.

If, in relation to the speed of the coin, the time interval between measuring the frequency with phase change and measuring it without phase change is made sufficiently short, the change in coin position occurring between the two measurements does not introduce an error in the effective resistance measurement sufficiently great to render the results unacceptably inaccurate.

However, preferably, the derived value, which is dependent on the effective resistance in the tuned circuit as influence by the coin, is compensated for the effect of the change in position of the moving coin occurring between the two frequency measurements. In this way the accuracy of the measurement can be improved, or a higher coin speed can be accommodated, or a lower phase change switching rate can be employed. This is especially the case when the measurements to be used for coin validation are taken at a time when the oscillation frequency is changing, and especially when it is changing quickly, due to the movement of the coin.

Preferably, the method comprises repeatedly imposing, then removing, said phase change, repeatedly measuring said frequency with and without the imposed phase change, interpolating between either the frequency values measured with the phase change, or those measured without the phase change, to develop compensated frequency values, and utilising the compensated frequency values in deriving said resistance-dependant value.

BRIEF DESCRIPTION OF THE DRAWINGS

In order that the invention may be more clearly understood, two embodiments will now be described, by way of example, with reference to the accompanying diagrammatic drawings in which.

DETAILED DESCRIPTION

Figure 1:
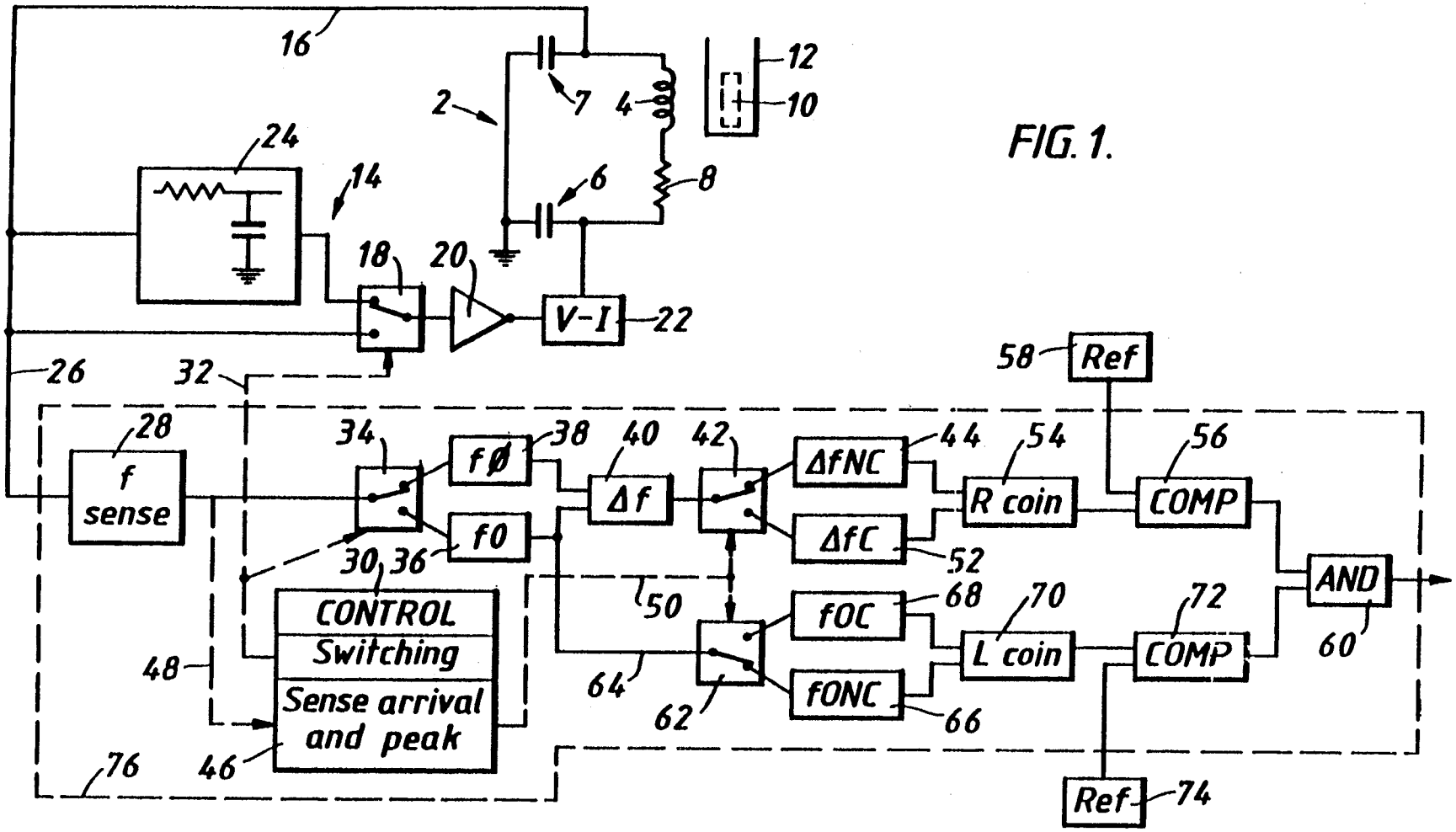
FIG. 1 shows schematically a first embodiment of the invention.

Referring to FIG. 1, a pi-configuration tuned circuit 2 includes an inductor in the form of a single coil 4, two capacitors 6 and 7 and a resistor 8. Resistor 8 is not normally a separate component and should be regarded as representing the effective resistance in the tuned circuit, which will consist primarily of the inherent resistance of the coil 4.

Means is provided for moving a coin shown in broken lines at 10 past and adjacent to the coil 4, the means being shown schematically as a coin passageway 12 along which the coin moves on edge past the coil. A practical arrangement for passing a moving coin adjacent to an inductive testing coil is shown, for example, in GB-A-2 093 620, the disclosure of which is incorporated herein by reference. As the coin 10 moves past the coil 4, the total effective resistance in the tuned circuit increases, reaching a peak when the coin is centred relative to the coil, and then decreases to an idling level. In the present example the apparatus is responsive to the peak value of this effective resistance.

The tuned circuit 2 is provided with a feedback path so as to form a free-running oscillator. The feedback path is generally indicated at 14 and includes a line 16 which carries the voltage occurring at one point in the tuned circuit, a switching circuit 18, and an inverting amplifier 20 which provides gain in the feedback path. A phase delay circuit shown schematically at 24 is alternately switched into the feedback path, or by-passed, depending on the condition of switching circuit 18. The phase shift round the feedback path is 180° when the phase delay circuit 24 is not switched into it, and the phase shift across the pi-configuration tuned circuit is then also 180°. In this condition the oscillator runs at its resonant frequency.

Figure 2:
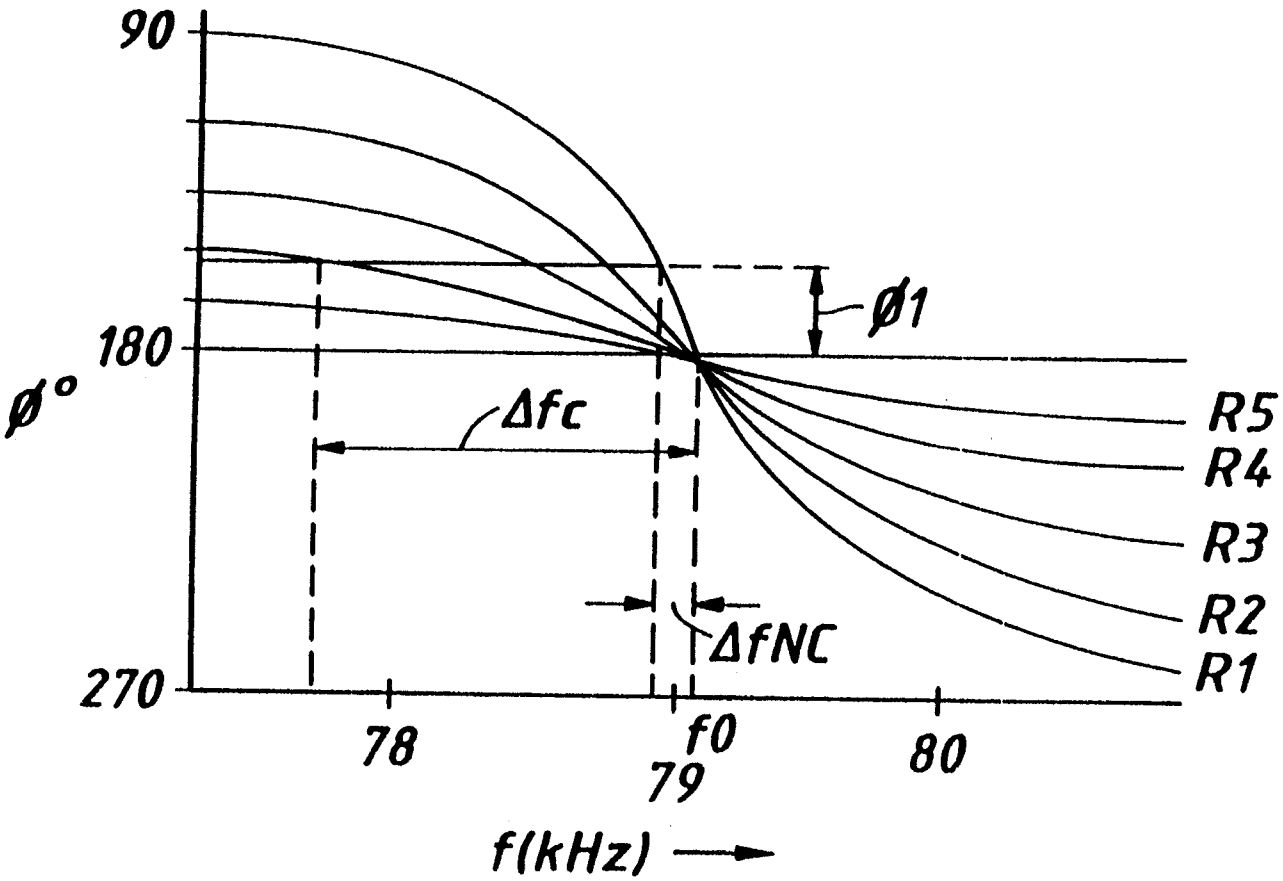
FIG. 2 illustrates the relationship between frequency, phase and effective resistance in a tuned circuit.

It is convenient now to refer to FIG. 2. FIG. 2 shows the relationship between frequency of oscillation and amount of phase shift ($\phi$) in the feedback path for five different values of total effective resistance in the tuned circuit, from a relatively low value R1 to a relatively high value R5. In general terms, for a pi-configuration tuned circuit in which the effective resistance is variable, the amount of effective resistance in the circuit at any particular time can be determined by changing the amount of phase shift in the feedback path from one known value to another (or by a known amount) and measuring the resulting change in frequency. The relationship between the phase shift change and the frequency change effectively represents the gradient of one of the curves shown in FIG. 2 and consequently indicates on which curve the circuit is operating and hence what is the present effective resistance in the circuit. For example, if the phase shift is changed from 180° by an amount $\phi 1$ (which may be about 30°) as shown and the frequency changes by ΔfNC then the effective resistance is the low value R1; but, if the frequency changes by the larger amount ΔfC the effective resistance is the higher value R4.

This technique is implemented for testing coins by the circuitry schematically shown in FIG. 1, the description of which will now be completed.

The frequency of the oscillator is fed on line 26 to a frequency sensing circuit 28. A control circuit 30 repeatedly operates switching circuit 18 by a line 32 to switch the phase delay circuit 24 into and out of the oscillator feedback path. Via the same line 32 it also operates a switch 34 in synchronism with switching circuit 18 so that the values of the frequency sensed by sensing circuit 28 are stored in store 36 (this being the frequency value when the phase delay is not present in the oscillator circuit) and store 38 (this being the frequency value when the phase delay is introduced into the oscillator circuit). FIG. 1 and the following description may be better understood by reference to the following table of the notation used for various frequencies and frequency differences:

f0=frequency without phase shift
$f\phi$=frequency with phase shift
$\Delta f = f\phi - f0$
ΔfNC=Δf when coin absent
ΔfC=peak value of Δf when coin present
fOC=peak value of f0 when coin present
fONC=value of f0 when coin absent A subtracter 40 subtracts f0 from $f\phi$ to develop Δf and, in the normal condition of a switch 42, this value of Δf is passed to a store 44. This normal condition prevails while there is no coin adjacent to coil 4, in which case the effective resistance in the tuned circuit is low (say, the low value R1 of FIG. 2) and the frequency difference value being stored at 44 is then ΔfNC (indicated in FIG. 2), this value being indicative of the inherent effective resistance of the tuned circuit itself at the time when the measurements are being taken.

As a coin 10 begins to arrive adjacent to coil 4, f0 at the output of frequency sensing circuit 28 starts to change. A section 46 of control circuit 30 detects the beginning of this change from line 48 and in response changes the condition of switch 42 via line 50, causing the recent idling value of ΔfNC to be held in store 44.

As the coin 10 approaches and reaches a position central relative to coil 4, so the frequency f0 falls until it reaches a peak low value. Circuit section 46 is adapted to detect this peak occurring and, in response, it causes switch 42 to direct the value of Δf occurring when the coin is centred, to store 52. This is value ΔfC, for example, as shown on FIG. 2, and it is the maximum value of frequency shift resulting from the imposed phase change $\phi 1$ that occurs during the passage of the coin past the inductor. This frequency shift indicates that the total effective resistance in the tuned circuit is now the relatively high value R4 consisting of the effective resistance inherent in the circuit plus the effective resistance introduced into it by the particular coin which is now centred on the coil 4. A value indicative of the effective resistance introduced by the coin alone is then derived by subtracter 54 which subtracts ΔfNC from ΔfC.

The resulting signal is compared in a comparison stage 56 with a reference value from reference circuit 58, the reference value being indicative of the effective resistance value expected to be obtained from an acceptable coin. The reference value may be stored either as two limits defining a range, or as a single value to which a tolerance is applied before comparison. If the comparison indicates acceptability a signal is provided to AND circuit 60.

In practice, one or more other tests will be carried out on the coin, and for each test value that matches a reference value, for the same type of coin, a further input is applied to AND circuit 60. When all the inputs, one for each of the tests, are present, indicating that the coin being tested has produced a complete set of values matching the respective reference values for a given denomination of coin, the AND circuit 60 produces an accept signal at its output to cause the coin to be accepted, for example by operating an accept/reject gate in well known manner.

Facilities for carrying out one particular further test, indicative of the amount of inductance introduced by the coin into the tuned circuit 2 and hence dependent upon a different characteristic or combination of characteristics of the coin than was the resistance test, are also included in FIG. 1. The value of f0 (i.e. oscillation frequency without any imposed phase shift) is applied to a switch 62 via line 64. Switch 62 is operated by the arrival sensing and peak detecting section 46 of control circuit 30 in the same manner as switch 42. Consequently, the "coin absent" or idling frequency without phase delay becomes stored in store 66, and the "coin present" peak low frequency reached without phase delay as the coin passes the inductor 4 becomes stored in store 68. These frequencies are indicative of the total inductance in the tuned circuit itself, and with the additional influence of the coin, respectively. They are subtracted by a subtracter 70 to give a value indicative of the inductance change caused by the coin, which is compared in a comparator 72 with a reference value for an acceptable coin stored in reference circuit 74, in a similar way to the comparison made by comparison circuit 56 as described above. The output of comparator 72 forms a further input to AND gate 60 so that the coin can only be accepted when both the effective resistance and the inductance it introduces into the tuned circuit 2 are appropriate to the same denomination of acceptable coin.

The embodiment of FIG. 1 has been described above, and illustrated, in terms of switches and functional blocks, but all the components shown within the broken-line box 76 can be implemented by means of a suitably programmed microprocessor. The programming falls within the skills of a programmer familiar with the art, given the functions to be achieved as explained above.

Figure 3:
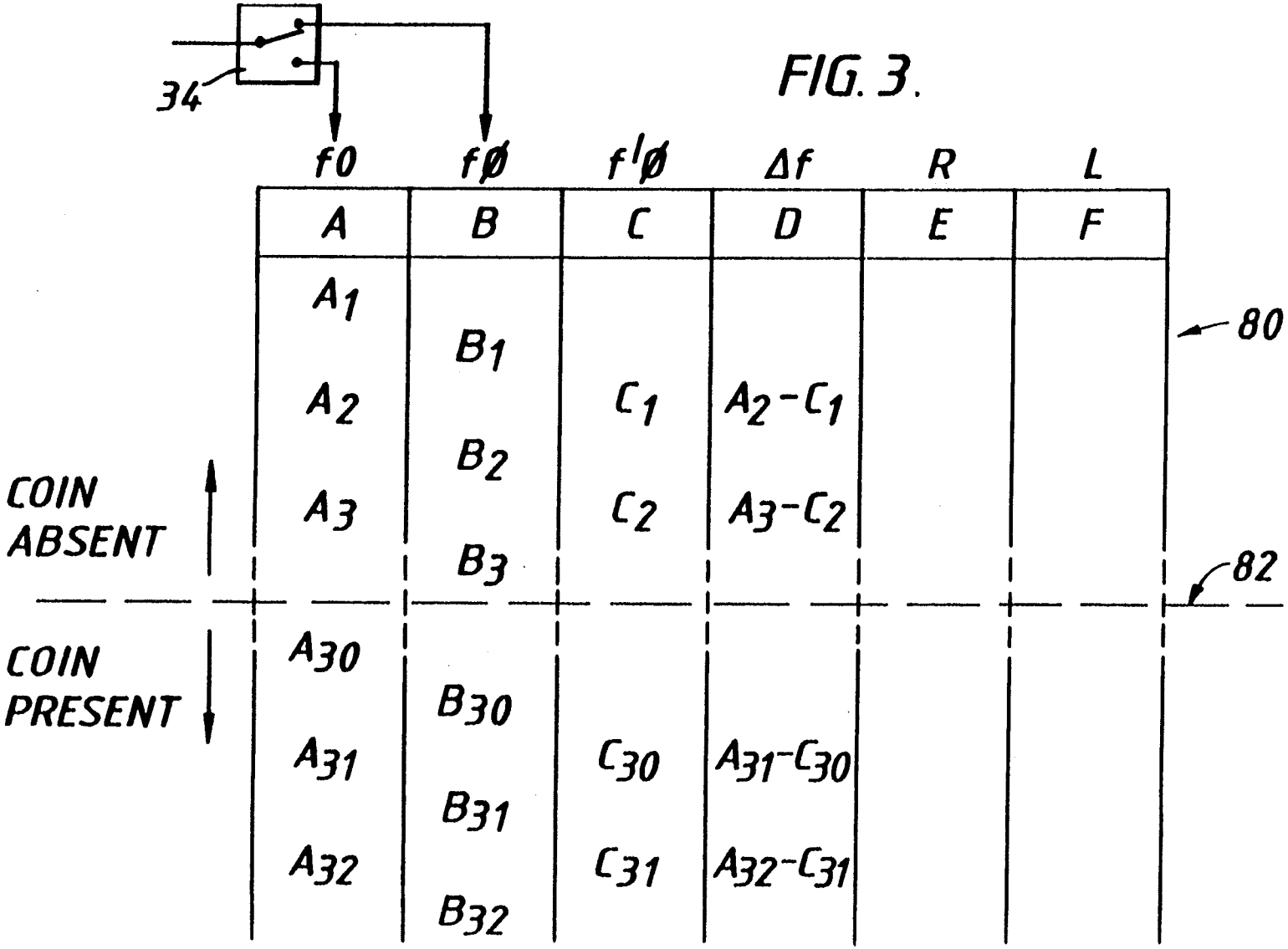
FIG. 3 illustrates how the embodiment of FIG. 1 may be modified to enable compensation for coin movement to be applied.

FIG. 3 relates to a modification of the apparatus of FIG. 1 which compensates for the fact that successive frequency measurements taken when the phase shift is in the circuit, and when it is not, relate respectively to the coin when it is in two different positions, since essentially the two frequency measurements are made at different times, and the coin is moving.

FIG. 3 shows a storage array 80 which, in conjunction with a suitable computing facility (not shown) is in effect substituted for the components which lie between switch 34 on the one hand, and subtracters 54 and 70 on the other hand, in FIG. 1. In the illustration of the array 80, the vertical axis represents time. The successive values of f0 are loaded into column A of the array, the values being indicated as $A_1 \ldots A_{32}$. The successive values of $f\phi$ are loaded into column B, these being indicated as $B_1 \ldots B_{32}$. The $f\phi$ measurements are interleaved, in time, between the f0 measurements because, of course, it is not possible to measure both simultaneously which, with a moving coin, would be desirable if it were possible.

To compensate for this, compensated values ($f'\phi$) of $f\phi$ are calculated and entered into column C. The first compensated value $C_1$ is the average of real values $B_1$ and $B_2$, the compensated value $C_2$ is the average of real values $B_2$ and $B_3$, and so forth. By this process of interpolation, a set of values for $f'\phi$ are developed in column C which, to a reasonable approximation, are what the corresponding values of $f\phi$ would have been if it had been possible to measure them at the same time as f0 was being measured. Compensated values of $\Delta f$ can be computed from the f0 values in column A and the $f'\phi$ values in column C, for example $A_2-C_1$ and so forth. Consequently, columns A and D of the array will respectively contain the histories of the frequency of oscillation without phase shift, and the compensated frequency shift caused by the phase shift, as a coin moves past the inductor.

The time at which a coin starts to enter the field of the inductor may be detected in various known ways, for example by constantly checking for f0 changing by more than a predetermined amount in a given predetermined short period of time. Such detection can be used to define a position in the array, indicated by broken line 82, above which the values relate to the coil alone and below which the values relate to the coil as progressively influenced by the coin entering into, and eventually moving out of, its field.

A peak value of R for the coin alone can be computed by subtracting from the peak value of $\Delta f$ occurring below line 82 a value of $\Delta f$ which occurs above line 82. Preferably, though, for additional accuracy, an average of several $\Delta f$ values occurring around the maximum value will be taken to represent the peak, and an average of several $\Delta f$ values occurring before the coin arrives will be taken to represent the idling value. A peak value of L for the coin alone may be calculated in similar manner but using the f0 values from column A of the array.

Alternatively, values of R and L for the coil as influenced (if at all) by a coin may be calculated for each pair of f0 and $\Delta f$ values occurring in columns A and D, the calculated R and L values being entered in columns E and F of the array. Columns E and F will then contain the histories of R and L, for the coil plus any influence of the coin from before the coin arrives until after it has left the inductor, these values of course relating to the coil alone during the periods before arrival of the coin and after its departure. This enables not only peak values for R and L of the coin alone, but also non-peak values if desired, to be derived, by subtraction, from columns E and F respectively.

However the values are derived, they may be compared with references as described in relation to FIG. 1.

Although the inductor is shown as a single coil, it may have other configurations, such as a pair of coils opposed across the coin passageway and connected in parallel, series aiding or series opposing.

In the above description, reference has been made to making measurements when the oscillator frequency is at a peak value. However, because the frequency is measured only at intervals, it is possible, and indeed likely, that on many occasions the measured values do not include the exact most extreme frequency value that is actually reached, or would have been reached if oscillation frequency had not been altered by the introduction or removal of phase shift, that is to say the measurements relied upon are taken while frequency is changing. It is also known to deliberately make use of measurements which are taken whilst frequency is changing due to movement of the coin. It is in these circumstances that the compensation technique, particular by interpolation, enables the greatest improvement in accuracy to be achieved.

It is thought to be desirable, in order for a peak measurement to be adequately representative of the actual extreme value, or extreme value that would have occurred, for at least ten R values to be measured during the passage of the smallest acceptable coin past the sensor, involving ten measurements with phase shift and ten without. Presently, the smallest of the world's coins needing to be accepted would be the Dutch 10 cent coin having a diameter of 15 mm, in which case approximately ten R measurements would need to be made per 15 mm of coin travel, the result then being more than ten such measurements when the same sampling rate was applied to coins of larger diameter. It has been found that this can be achieved if the track on which the coin moves freely is inclined at an angle of between 10° and 20° to the horizontal, preferably between 13° and 15° and the periods for which the phase shift is switched in, and also out, are respectively not longer than about 1.6 mS, and preferably around 0.8 mS.

It is known that measurements taken using relatively high and relatively low frequencies give information about the coin material at different depths within the coin, due to the skin effect. The invention enables the effective resistance in the tuned circuit to be measured at higher frequencies than is practically possible using amplitude-measurement techniques. Hence, the invention enables effective resistance measurements to be made more selectively.

Although in the prior art techniques based on amplitude measurements it was the intention to determine the effective resistance introduced into a circuit by the proximity of a coin, it was known that amplitude was sensitive to variations in parameters other than effective resistance and this was a source of potential error. Hence, it was desirable to take special design steps to minimise or compensate for the variations in the relevant parameters, and this increased cost and complexity. The phase-change induced frequency shift used in the present invention is substantially insensitive to variations in parameters other than effective resistance in the tuned circuit, and therefore by subtracting the "coin absent" measurement from the "coin present" measurement a more accurate determination of the effective resistance introduced by the coin itself can be made, without additional costly steps, including the cost of a coin stopping and releasing mechanism as required by the prior art mentioned previously.

Furthermore, whereas amplitude takes a period of time to stabilise after the oscillator is switched on, frequency becomes established at a stable value virtually instantaneously, so that the invention facilitates switching the sensors in a multi-sensor apparatus on and off one at a time to save power or avoid interference, or both, without resorting to an undesirably slow rate of switching.

I claim:

1. A method of testing coins using an oscillating tuned circuit which includes an inductor, three parameters of the tuned circuit being interdependent, namely:

a) the effective resistance in the circuit b) the phase of a signal in the circuit, and c) the frequency of oscillation of the circuit, the method comprising imposing a change in said phase when a coin is adjacent to the inductor, deriving from the resulting frequency change a value dependent on the effective resistance in the tuned circuit as influenced by the coin, and using the derived value in a coin acceptability check, characterised by causing the coin to move past the inductor during said phase change and the resulting frequency change.

2. A method as claimed in claim 1 wherein the oscillator is a free-running oscillator having a feedback path, and comprising changing the phase shift occurring in the feedback path.

3. A method as claimed in claim 1 comprising imposing said change when there is no coin adjacent to, and also when there is coin adjacent to, said inductor, and deriving said value as a function of both of the "coin present" and "coin absent" changes in frequency.

4. A method as claimed in claim 3, comprising deriving said value as the difference between the "coin present" and "coin absent" changes in frequency.

5. A method as claimed in claim 1, comprising deriving an inductance-dependent value which is a function of the frequency when there is no coin adjacent to, and also when there is a coin adjacent to, said inductor when said phase is the same in both cases, and using the derived inductance-dependent value in said coin acceptability check.

6. A method as claimed in claim 1, comprising measuring said frequency with and without said imposed phase change, and compensating the derived value for the effect of the change in position of the moving coin occurring between the two frequency measurements.

7. A method as claimed in claim 6 comprising repeatedly imposing, then removing, said phase change, repeatedly measuring said frequency with and without the imposed phase change, interpolating between either the frequency values measured with the phase change, or those measured without the phase change, to develop compensated frequency values, and utilising the compensated frequency values in arriving at said frequency change.

8. Apparatus for testing coins, comprising a tuned circuit including an inductor and means for causing the tuned circuit to oscillate, three parameters of the tuned circuit being interdependent, namely:

a) the effective resistance in the circuit b) the phase of a signal in the circuit, and c) the frequency of oscillation of the circuit, means for positioning a coin adjacent to said inductor so as to influence the effective resistance in the tuned circuit, means for imposing a change in said phase, means for deriving from the resulting change in said frequency a value dependent on the effective resistance in the tuned circuit as influenced by the coin, and means for using the derived value in a coin acceptability check, characterised in that the means for positioning the coin is a coin passageway arranged to permit the coin to move freely past the inductor while said phase change is being imposed.

9. Apparatus as claimed in claim 8 wherein said means for causing the tuned circuit to oscillate is a feedback path including a gain element, whereby to form with the tuned circuit a free-running oscillator.

10. Apparatus as claimed in claim 9 comprising phase changing means in the feedback path.

11. Apparatus as claimed in claim 8 comprising control means for operating the change-imposing means when there is no coin adjacent to, and also when there is a coin adjacent to, said inductor, and wherein said deriving means is operable to derive a value which is a function of the "coin present" and "coin absent" changes in frequency.

12. Apparatus as claimed in claim 11 wherein said deriving means takes the difference between the "coin present" and "coin absent" changes in frequency.

13. Apparatus as claimed in claim 8 including means for sensing said frequency, means for deriving from the sensed frequency a value dependent on the effective inductance in the tuned circuit as influenced by the coin, and means for using the derived inductance-dependent value in said coin acceptability check.

14. Apparatus as claimed in claim 13 comprising means for detecting the sensed frequency when there is no coin adjacent to, and also when there is a coin adjacent to, said inductor when said phase is the same in both cases, and wherein the means for deriving the inductance-dependent value derives that value as a function of the "coin present" and "coin absent" frequencies.

15. Apparatus as claimed in claim 8 comprising means for measuring said frequency with and without said imposed phase change, and means for compensating the derived value for the effect of the change in position of the moving coin occurring between the two frequency measurements.

16. Apparatus as claimed in claim 15 wherein said phase change imposing means is operable to repeatedly impose, then remove, said phase change, said frequency measuring means is operable to measure said frequency repeatedly with and without the imposed phase change, and said compensating means develops compensated frequency values from either the frequency values measured with the phase change, or those measured without the phase change, by interpolating between the measured values, said deriving means being adapted to derive said resistance-dependent value, from a frequency change arrived at using the compensated frequency values.

* * * * *